US005800259A

United States Patent [19]

Olney

[11] Patent Number: 5,800,259

[45] Date of Patent: Sep. 1, 1998

[54] GRILL ASSEMBLY

[75] Inventor: John R. Olney, New Carlisle, Ind.

[73] Assignee: B & B Molders, L.L.C., Mishawaka, Ind.

[21] Appl. No.: 707,234

[22] Filed: Sep. 3, 1996

[51] Int. Cl.[6] ..... F24F 13/06

[52] U.S. Cl. ..... 454/109; 454/108; 454/137; 454/152; 454/155; 454/316; 454/331

[58] Field of Search ..... 454/108, 109, 454/136, 137, 152, 155, 299, 316, 330, 331, 332

[56] References Cited

U.S. PATENT DOCUMENTS

| | | | |
|---|---|---|---|
| 2,314,850 | 3/1943 | Woelfel | 454/109 |
| 2,709,402 | 5/1955 | Malm . | |
| 2,868,102 | 1/1959 | Melgaard | 454/316 |
| 3,203,338 | 8/1965 | Dry | 454/332 X |
| 3,401,620 | 9/1968 | Armstrong et al. . | |
| 3,559,560 | 2/1971 | Trahan | 454/330 X |
| 3,815,638 | 6/1974 | Martin | 454/331 X |
| 3,913,468 | 10/1975 | Kramer et al. | 454/109 |
| 4,020,752 | 5/1977 | Stephan . | |
| 4,090,436 | 5/1978 | Wright . | |
| 4,132,160 | 1/1979 | Robertshaw . | |
| 4,208,010 | 6/1980 | Beam, Jr. et al. | 454/331 X |
| 4,286,497 | 9/1981 | Shamah | 411/342 |
| 4,439,079 | 3/1984 | Losada | 411/345 |
| 4,557,455 | 12/1985 | Benjamin | 248/496 |
| 4,887,522 | 12/1989 | Kuno et al. . | |
| 5,338,255 | 8/1994 | Akehurst | 454/330 X |

FOREIGN PATENT DOCUMENTS

| | | | |
|---|---|---|---|
| 3-28647 | 2/1991 | Japan | 454/330 |
| 4-174249 | 6/1992 | Japan | 454/330 |

*Primary Examiner*—Harold Joyce
*Attorney, Agent, or Firm*—Leydig, Voit & Mayer, Ltd.

[57] ABSTRACT

A grill assembly comprising an anchor member adapted to fit in a duct around the periphery of a duct opening. Tie members may be slidably attached to the anchor member so that it projects outwardly from the anchor member for receiving a frame. A damper and cover may be subsequently attached to the frame.

48 Claims, 5 Drawing Sheets

GRILL ASSEMBLY

FIELD OF THE INVENTION

The present invention relates to a grill assembly for covering ventilation duct openings and, more particularly, to a grill assembly for use in ventilation ducts in recreational vehicles and the like.

BACKGROUND OF THE INVENTION

Generally, rooms in recreational vehicles, residential and commercial properties and the like typically have ventilation ducts for delivering heated and/or cooled air through the interior of the room and space. The air ducts have inlets and/or outlets communicating with the room in order to introduce and/or receive air from the room. The air ducts typically have a grill assembly mounted to the walls and ceiling using fasteners such as screws, bolts and the like for covering the inlets and outlets for aesthetic and safety reasons. Unfortunately, the walls and ceiling surrounding the duct openings are typically made of relatively soft materials such as foam rubber, Styrofoam, or light weight plywood so that this type of construction frequently permits the fasteners to strip out, causing the grill assembly to hang or completely fall out. Attempts to remedy this problem have included putting an extra piece of luan paneling in the ceiling to reinforce the ceiling and to provide a sturdy base for receiving the fasteners. Obviously, this results in an added construction step and increased manufacturing costs.

SUMMARY AND OBJECTS OF THE INVENTION

One object of the present invention is to provide a grill assembly which can be easily and quickly mounted to an air duct.

Another object is to provide a grill assembly which provides a sturdy anchor for the fasteners which can be quickly and easily assembled and disassembled.

A related object is to provide an improved grill assembly which provides a streamlined and attractive look.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
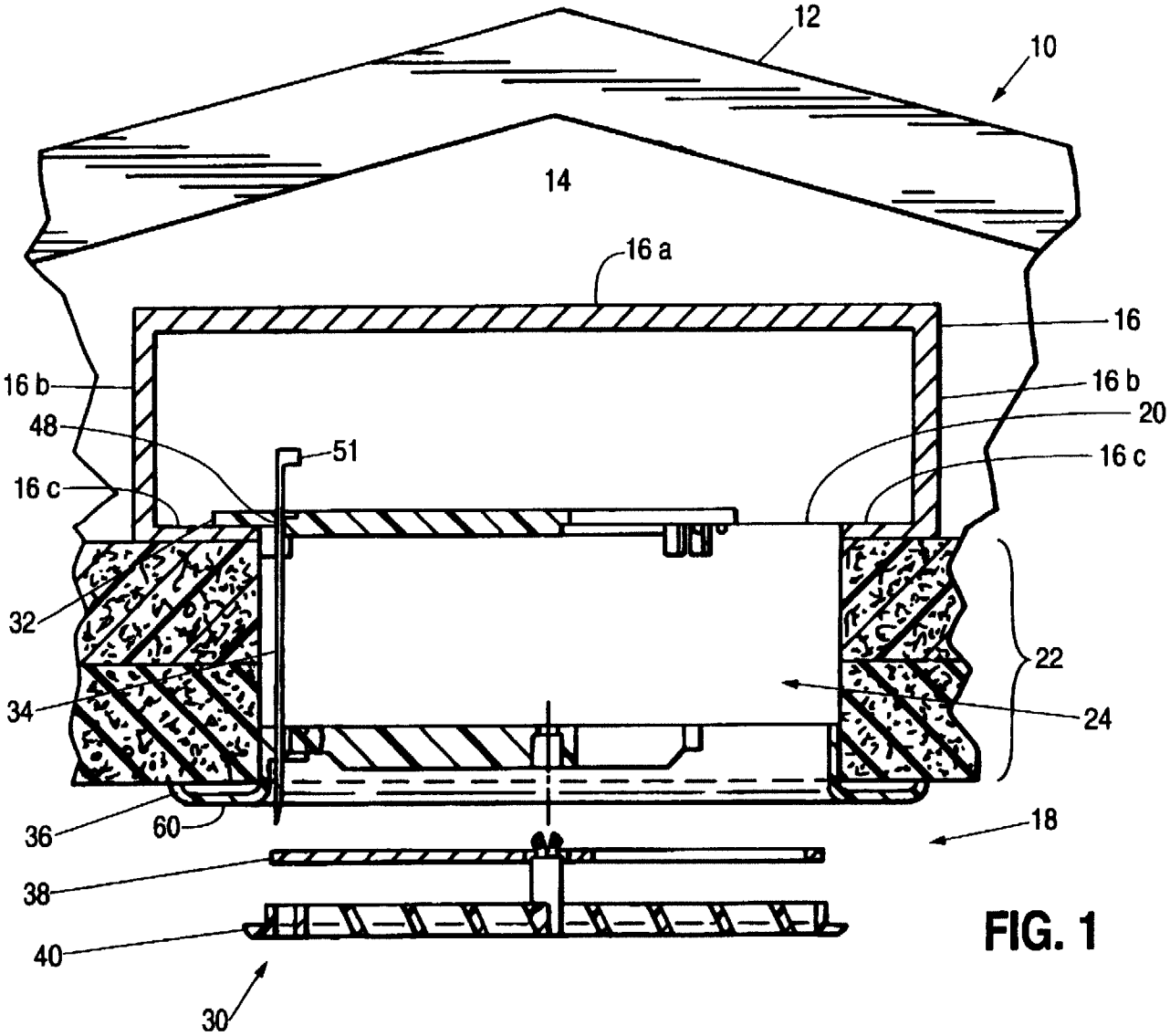
FIG. 1 is a cross-sectional view showing a grill assembly in accordance with the invention mounted in a typical vehicle ceiling.

Referring to FIG. 1, there is shown a duct assembly typically found in structures such as residential and commercial properties, recreational vehicles and the like. The recreational vehicle 10 typically has a ceiling 12 defining a crawl space 14 for receiving ventilation ducts 16, electrical wiring, and the like. The conventional ventilation duct 16 is used for conveying air into and out of the room 18. The duct 16 may have any configuration including the rectangular configuration shown in FIG. 1. The duct 16 has top walls **16*a*, opposing side walls 16*b* and a bottom wall 16*c*. One of the walls, such as the illustrated bottom wall 16*c*, will define an opening 20 which serves as an inlet/outlet for the conditioned air (i.e., heated and/or air conditioned air). The duct opening 20 may have any configuration but will typically be circular or rectangular. After the ventilation ducts 16 have been installed into the vehicle 10, sheet materials such as Styrofoam and foam rubber are mounted to frame members (not shown) to form the ceiling 22 as illustrated or other interior walls. The ceiling 22 or wall will have an opening 24 substantially conforming to the configuration of the duct opening 20**.

Figure 3:
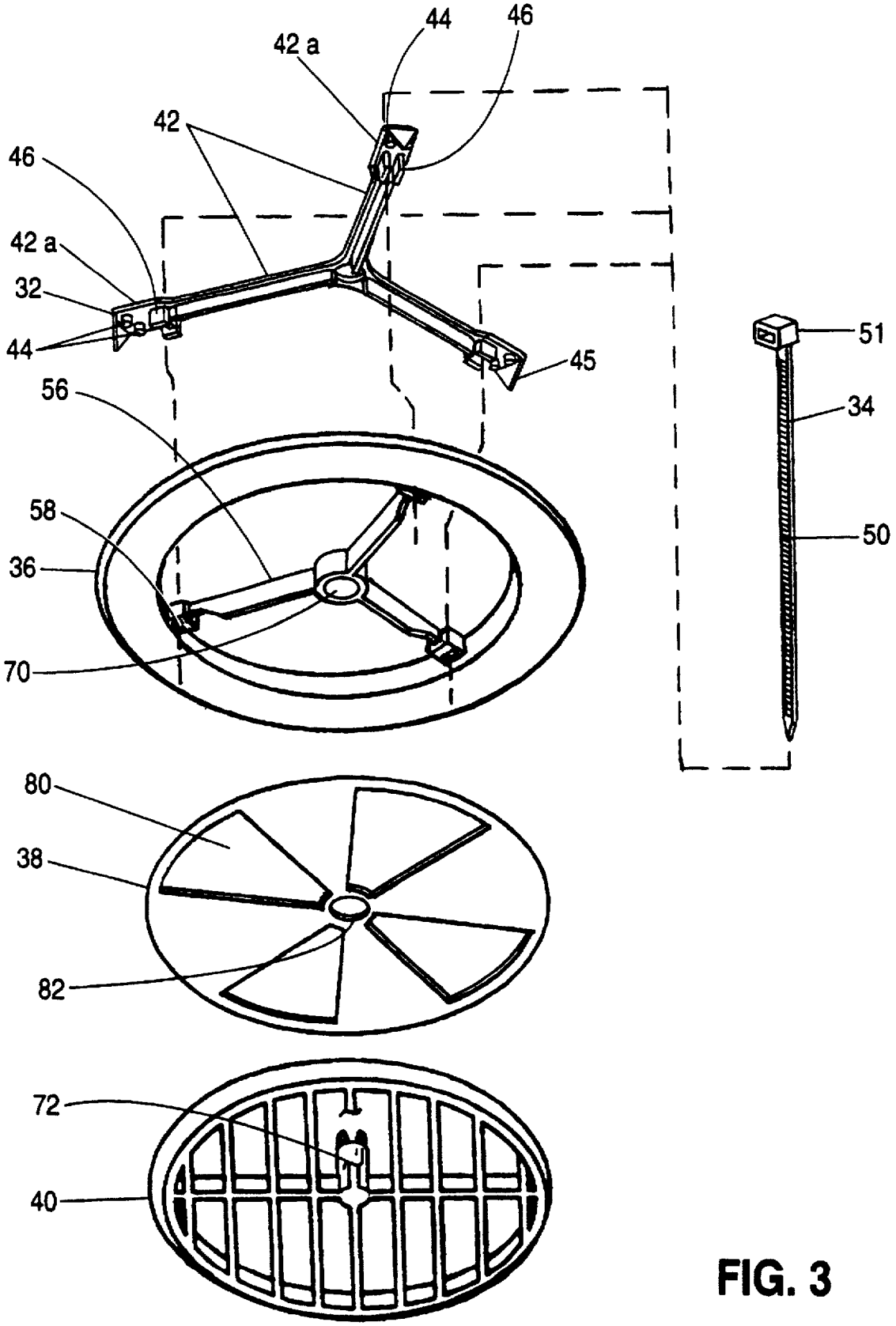
FIG. 3 is an exploded view of the grill assembly.
Figure 5:
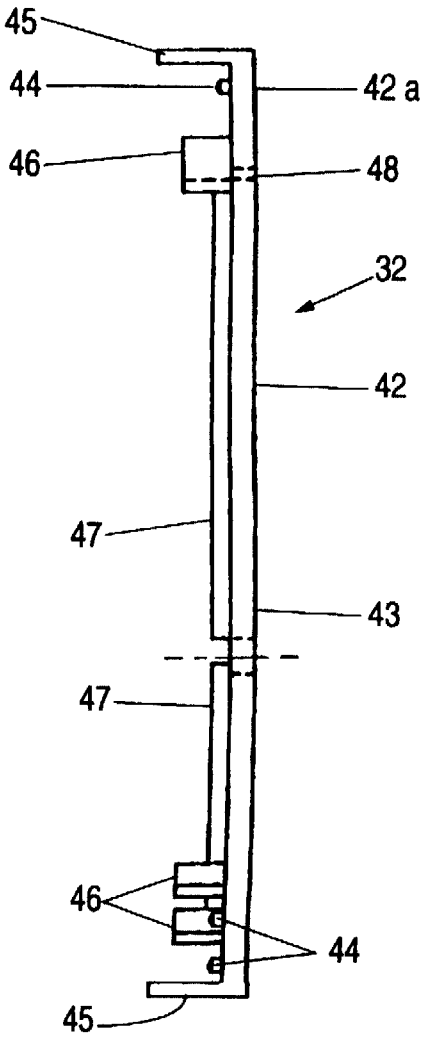
FIG. 5 is a side elevation of the anchor shown in FIG. 3.
Figure 4:
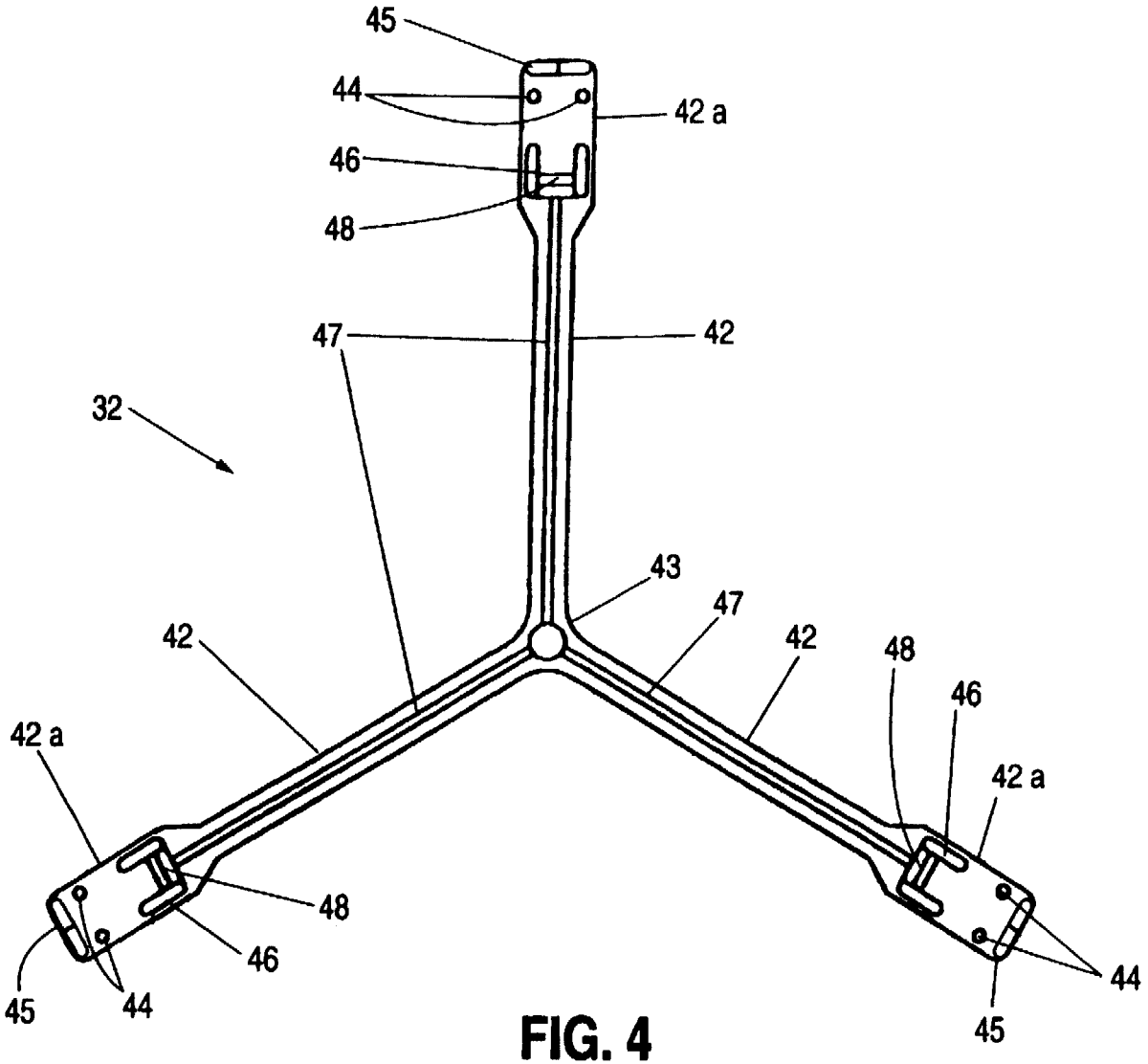
FIG. 4 is a front elevation showing a grill anchor which is installed into the air duct.

In accordance with certain objects of the invention, FIG. 1 shows a grill assembly 30 mounted to the duct opening 20 and FIG. 3 shows an exploded view of the grill assembly 30. The grill assembly 30 comprises an anchor member 32 which is adapted to fit in the duct 16 around the periphery of the opening 20. Tie members 34 may be slidably attached to the anchor member 32 so that it projects outwardly from the anchor member 32 for receiving a frame 36. A damper 38 and cover 40 may be subsequently attached to the frame 36.

Referring to FIGS. 1 and 3–5, it will be seen that the anchor member 32 has a plurality of arms 42 projecting from the center 43 of the anchor member 32 for engaging the periphery of the opening 20 and supporting the other components of the grill assembly 30. The present embodiment of the anchor member 32 has three projecting arms 42, but other embodiments may have any number of arms 42, and each arm 42 may have different lengths adapted to engage the periphery of the opening 20 depending upon the particular configuration of the opening 20. Each arm 42 may have a spacer member 46 projecting from the outer end **42*a* for assisting in the alignment of the arm 42 about the peripheral edge of the duct opening 20 and a rib 47 for reinforcing the arm 42. The outer ends 42*a* of the arms 42 preferably have means for securing the anchor member 32 to the duct opening 20 to prevent inadvertent movement. In the illustrated embodiment, the arms 42 have a plurality of prongs 44 projecting from the outer ends 42*a* which are adapted to securely engage corresponding holes (not shown) in the duct walls 16*c* defining the opening 20. It is preferable that the prongs 44 be dimensioned so as to press fit into the corresponding duct holes for securely attaching the anchor member 32 to the duct wall 16*c*. In the illustrated embodiment, the arms also have a finger 45 projecting from the arm which passes through holes (not shown) in the duct to engage the sheet material and to prevent movement therebetween. In other embodiments, the arms may have either the prongs 44, or the fingers 45. It will also be appreciated that other engaging means may also be used to securely attach the anchor member 32 to the opening 20 including for example bolts, screws and the like. The location of the prongs 44, the fingers 45 and the corresponding holes may be reversed such that the duct walls 16***c* have the plurality of projecting prongs and fingers and the corresponding holes are disposed in the anchor member 32. In other embodiments, the space members 46 may also be dimensioned and adapted to press fit into the duct opening 20 for securing the anchor member 32. If the grill assembly 30 is to be used in a ceiling opening, although preferable, it is not necessary that arm 42 be securely attached to the duct walls 16*c* since the arm 42 will be supported by the duct wall 16*c*.

Figure 2:
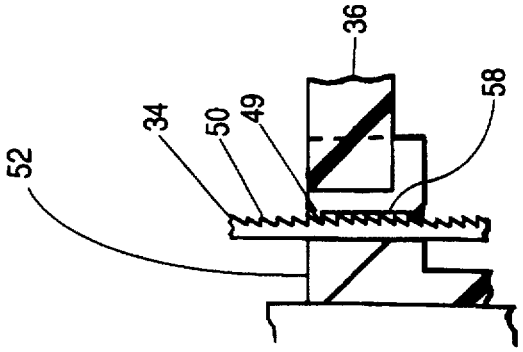
FIG. 2 is an enlarged, cross-sectional view of FIG. 1.

The outer end 42*a* of the arm member 32 has an anchor aperture 48 for slidably receiving the tie member 34. In the embodiment illustrated in FIG. 2, the aperture 48 is disposed between spacer members 46 and defines a shoulder 49. The tie member 34 is typically made of plastic material and has a plurality of teeth 50 and a stop member 51 to limit insertion of the tie member 34. The teeth 50 define an incline 50*a* and a step 50*b* such that the tie member 34 can be slidably inserted into the anchor aperture 48 in one direction but the subsequent engagement between the shoulder 49 and step 50*b* prevent withdrawal in the opposite direction as shown in FIG. 2. In other embodiments, the aperture 48 may not have a shoulder 49 so that the tie member 34 may freely engage the aperture 48 in either direction.

Figure 8:
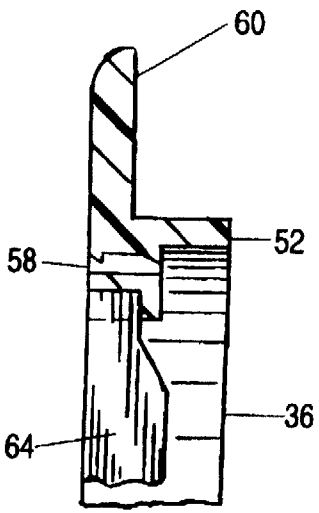
FIG. 8 is an enlarged cross-section taken along line 8—8 in FIG. 6.
Figure 7:
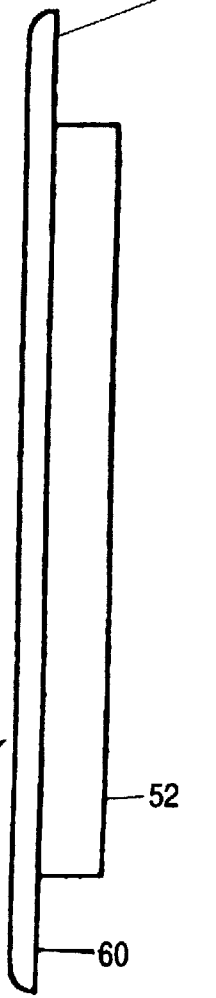
FIG. 7 is a side elevation of the frame shown in FIG. 6.
Figure 6:
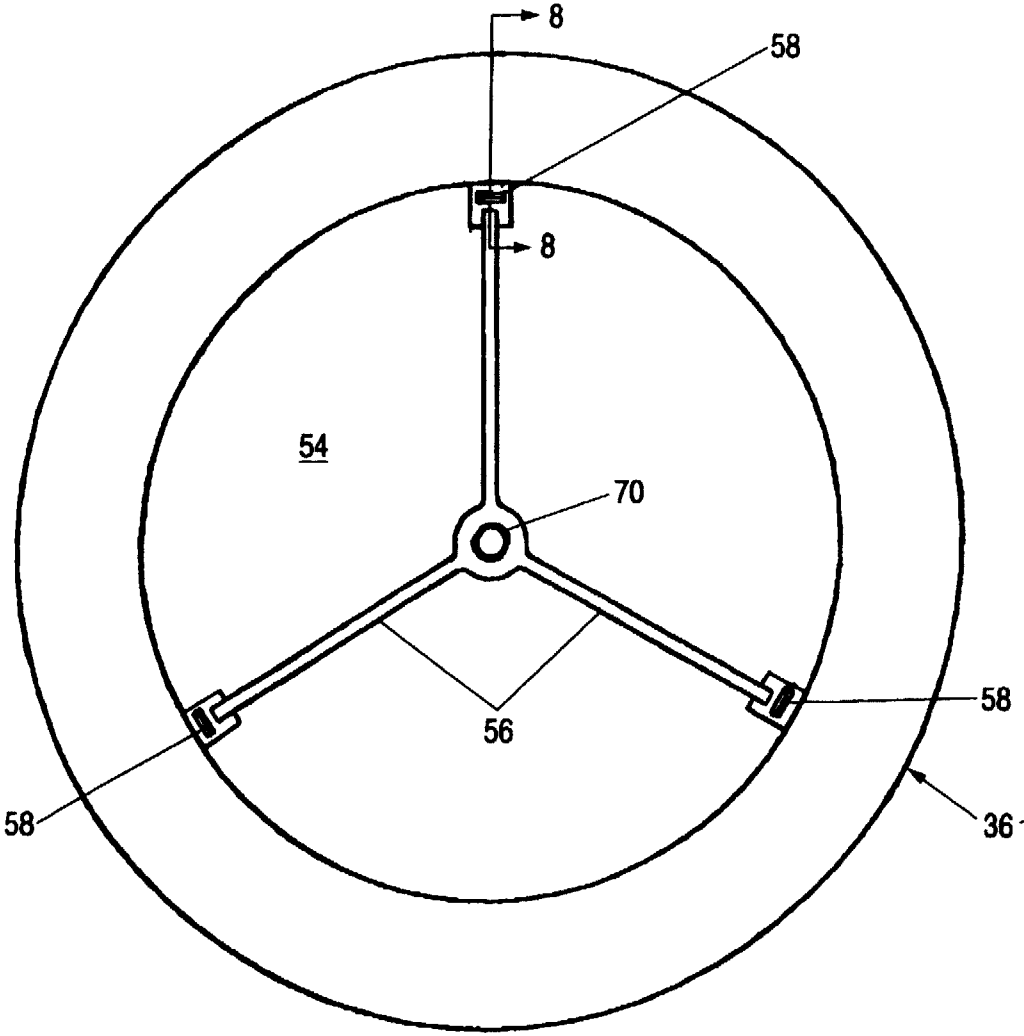
FIG. 6 is a front elevation showing a grill frame.

Referring to FIGS. 6–8, it will be seen that the frame 36 has a side wall 52 adapted to slidably engage and conform to the periphery of the opening 24 defined by the ceiling panels 22 and properly align the frame 36. In the present embodiment, the side wall 52 has a circular configuration corresponding with the configuration of the ceiling opening 24. The side wall 52 defines a central opening 54 permitting conditioned air to pass into the room. A plurality of reinforcing ribs 56, disposed in the central opening 54, have frame apertures 58 which are adapted to slidably receive the tie member 34. Each frame aperture 58 is configured like the anchor aperture 48 to slidably receive the teeth 50 so that the tie member 34 may be inserted in one direction but it may not be withdrawn in the reverse direction. It will be appreciated that the position of the frame aperture 58 corresponds with the position of the frame aperture 48 in the anchor member 32. The outer periphery of the wall 52 has an outwardly projecting shoulder 60 for engaging the ceiling panels 22 and limiting the insertion of the frame member 36 into the opening 24. The configuration of the wall 52 and the shoulder 60 act to engage, reinforce and protect the relatively soft peripheral edge of the opening from damage.

The cover member or grill member 40 has a central body portion 62 configured to slidably engage a hollowed-out recess 64 in the frame member 36. The body portion 62 has an outwardly projecting shoulder 66 extending around the outer periphery for limiting the insertion of the grill member 40 into the frame opening 64. The grill assembly has means for securing the cover member 40 and the frame member 36 together. In the illustrated embodiment, the securing means comprises a snap member 68 projecting downwardly from the body portion 62 which is adapted to be inserted into a corresponding snap hole 70 in the frame member 36. The snap member 68 has at least one resilient finger 72 which is adapted to be press fit into the snap hole 70 in order to attach the cover member 40 to the frame member 36. It will be appreciated that the snap member 68 may be located on the frame 36 so as to receive and hold the cover member 40. Similarly, the cover member 40 may have apertures similar to the frame apertures 58 and the anchor apertures 48 which are adapted to securely receive the tie member 34.

Figure 10:
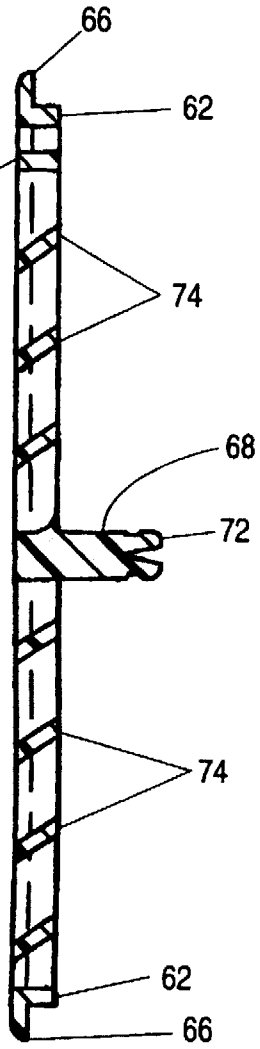
FIG. 10 is a cross sectional view taken along line 10—10 in FIG. 9 showing the vanes for directing the air flow and the snap mechanism for attaching the cover to the frame.
Figure 9:
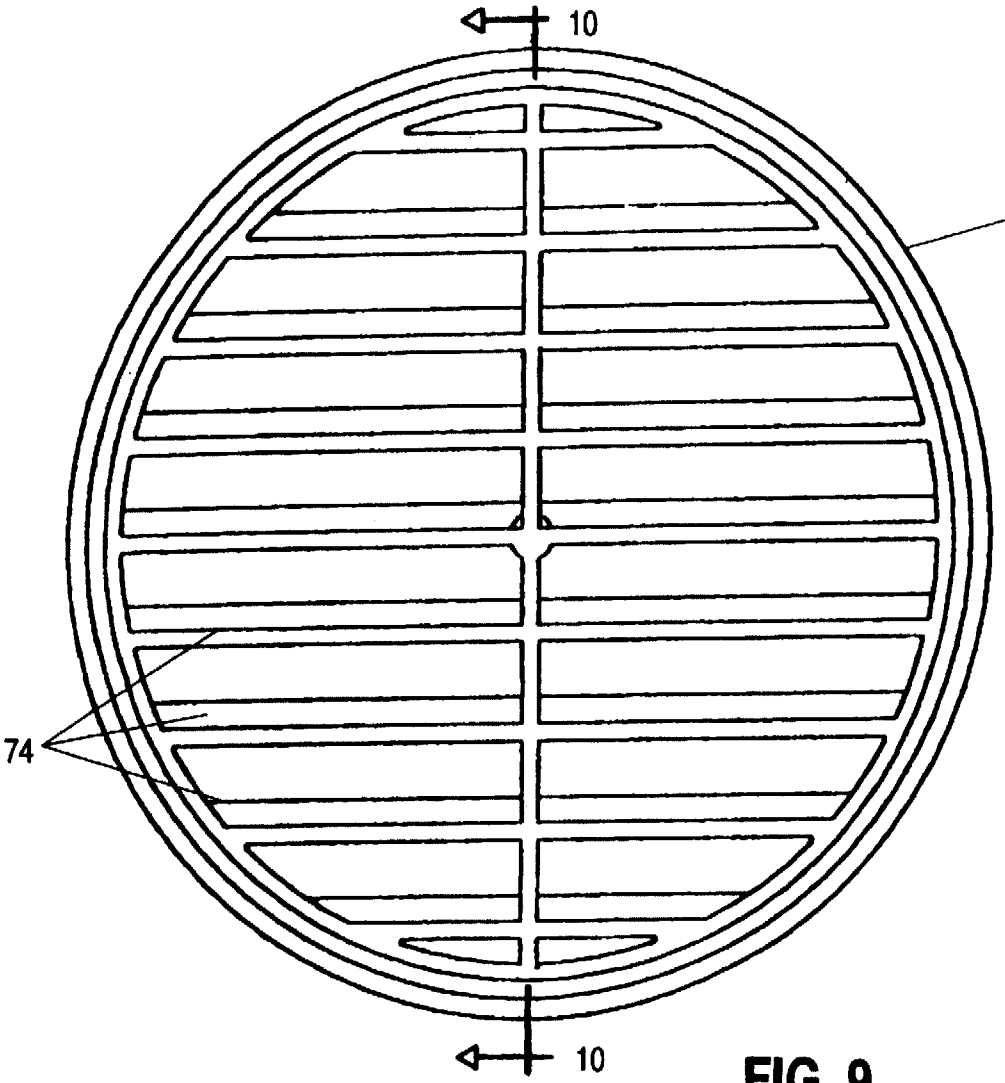
FIG. 9 is a front elevation of a grill cover.

Referring to FIGS. 9–10, it will be seen that the grill member 40 has a plurality of vanes 74 extending across the body of the grill member 40 which are inclined relative to the horizontal axis of the grill member 40. It will be appreciated that the press fit engagement of the snap member 68 permits the grill member 40 to be rotated relative to the frame member 36 so that an operator may control the direction of the air out of the duct opening 20. In the illustrated embodiment, the vanes 74 are unitarily molded with the body portion 62, but in other embodiments, the vanes 74 may be pivotably attached to the body portion 62 in order to permit variable directional adjustment of the air flow.

The grill assembly 30 preferably has a damper mechanism 38 as shown in FIG. 3 which may be disposed between the damper member 40 and frame member 36. The two damper plates 78*a*, 78*b* have a central aperture 82 for slidably receiving the snap member 72 such that the damper member 38 is supported by the grill member 40 when the grill member 38 is mounted to the frame member 36. The damper 38 preferably comprises two relatively thin flat plates 78*a*, 78*b* having a plurality of corresponding openings 80 so that rotating one damper plate 78*a* relative to the second damper plate 78*b* varies the size of the openings 80 between a fully open and a fully closed position thereby adjusting the air flow rate. In accordance with certain objects of the invention, once the grill member 40 is attached to the frame member 36, the grill member 40 covers the other internal components of the grill assembly 30, giving a pleasing streamlined and aesthetic appearance to the grill assembly.

In order to install the grill assembly 30, the tie members 34 are fully inserted through the anchor aperture 48 in the anchor member 32. The stop member 51 limits the insertion of the tie member. The anchor member 32 is subsequently inserted into the ventilation duct 16 and aligned so that the spacer members 46 engage the peripheral edge of the duct opening 20 and the prongs 44 and fingers 45 are aligned with the corresponding openings in the duct wall 16*c*, and/or the fingers 45 engage the sheet material. It will be appreciated that once the prongs 44 engage the corresponding openings in the duct wall 16*c*, the anchor member 32 cannot rotate or otherwise slide within the duct opening 20. When the anchor member 32 is properly mounted in the duct opening 20, the tie members 34 hang downwardly and project out of the duct opening 20 and the ceiling opening 24.

The frame member 36 is then placed in the ceiling opening 24 such that the tie members 34 may be slidably inserted into the frame apertures 58. Sliding the frame member 36 upwardly along the tie members 34 so that the body portion 52 is inserted into the ceiling opening 24 securely mounts the frame member 36 to the anchor member 32. In accordance with certain objects of the invention, the tension between the anchor member 32 and the frame member 34 may be adjusted by controlling the distance between the frame member 36 and the anchor member 32. Any excess tie members 34 projecting out of the frame member 36 may be cut using scissors or other cutting tools. It will be appreciated that the ceiling 22 and the duct wall 16*c* are sandwiched between the anchor member 32 and the frame member 36, thereby protecting the peripheral edges of the sheet material.

The two damper plates 78*a*, 78*b* are mounted on the grill member 40 so that the snap mechanism 70 protrudes through the central opening 82 in the damper plates 78*a*, 78*b*. The grill member 40, with the two damper plates 78*a*, 78*b*, are positioned so that a snap mechanism may be inserted into the frame opening. The grill member 40 may be rotated about the snap mechanism 70 to control the direction of the air. The amount of air introduced into the room may be controlled by the relative position of the damper plate 78*a*, 78*b* and the size of the corresponding openings 80.

The grill assembly 30 may be disassembled by withdrawing the grill member 40 (and the damper member 38), thereby exposing the frame member 36 and the tie members 34. Cutting the tie member 34 removes the tension between the anchor member 32 and the frame member 36, permitting the subsequent removal of the anchor member 32 and/or the frame member 36.

Thus it will be seen that a novel and improved grill assembly has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. A grill assembly for covering a duct outlet, the grill assembly comprising:

an anchor member for mounting in the outlet, a frame for covering the outlet, wherein the anchor member and frame have openings for permitting conditioned air to pass through the grill assembly, and means for attaching the frame to the anchor member having at least one anchor aperture disposed in the anchor member, at least one frame aperture disposed in the frame, and a tie member for slidably engaging the anchor and frame apertures and holding the anchor member and frame together.

2. The grill assembly as set forth in claim 1 wherein the frame aperture defines a shoulder and the tie member comprises a plurality of teeth permitting the tie member to slide across the shoulder in one direction but prevent movement of the tie member across the shoulder in the other direction wherein the anchor member and frame are moved towards each other as the teeth slide across the shoulder in the one direction wherein the anchor member and frame are moved toward each other as the teeth slide across the shoulder in the one direction.

3. The grill assembly as set forth in claim 1 comprising means for securely attaching the anchor member to the periphery of the outlet and preventing movement between the anchor member and the outlet.

4. The grill assembly as set forth in claim 3 wherein the means for securely attaching the anchor member to the periphery of the outlet comprises at least one prong on the anchor member for engaging a corresponding hole disposed in the periphery of the outlet.

5. The grill assembly as set forth in claim 4 wherein the prong has a configuration for press fitting into the corresponding hole.

6. The grill assembly as set forth in claim 3 wherein the means for securely attaching the anchor member to the periphery of the outlet comprises at least one finger on the anchor member for engaging a sheet material surrounding the duct outlet.

7. The grill assembly as set forth in claim 3 wherein the means for securely attaching the anchor member to the periphery of the outlet comprises at least one spacer for engaging the periphery of the outlet.

8. The grill assembly as set forth in claim 7 wherein the spacer has a configuration for press fitting into the outlet.

9. The grill assembly as set forth in claim 1 wherein the frame has a body portion configured to engage and prevent damage to the periphery of the outlet.

10. The grill assembly as set forth in claim 1 wherein the frame has a body portion configured to engage the periphery of the outlet and a shoulder projecting outwardly from the body portion for limiting insertion of the frame into the outlet.

11. The grill assembly as set forth in claim 1 wherein the frame comprises a plurality of vanes for directing the conditioned air.

12. The grill assembly as set forth in claim 1 wherein the frame comprises a damper for controlling the amount of conditioned air passing through the grill assembly.

13. The grill assembly as set forth in claim 1 comprising a cover for covering the frame and outlet and means for attaching the cover to the frame.

14. The grill assembly as set forth in claim 13 wherein the cover comprises a plurality of vanes for directing the conditioned air.

15. The grill assembly as set forth in claim 13 wherein the means for attaching the cover to the frame comprises a snap member disposed on the cover for slidably engaging a corresponding snap hole in the frame.

16. The grill assembly as set forth in claim 13 wherein the means for attaching the cover to the frame comprises a cover aperture for receiving the tie member.

17. A grill assembly for covering a duct outlet, the duct outlet defining interior and exterior peripheral edges, the grill assembly comprising:

an anchor member for mounting in the outlet having a middle portion and at least two arms extending from the middle portion for engaging opposing sides of the interior peripheral edge and releasably supporting the anchor member in the outlet without the need for a fastening member, a frame spaced from the anchor member for covering at least a portion of the exterior peripheral edge of the outlet, wherein the anchor member and frame have openings for permitting conditioned air to pass through the grill assembly, and means for attaching the frame to the anchor member having at least one anchor aperture disposed in the anchor member and at least one corresponding frame aperture in the frame, and a tie member for slidably engaging the anchor and frame apertures and holding the anchor member and frame together.

18. The grill assembly as set forth in claim 17 wherein the frame aperture defines a shoulder and the tie member comprises a plurality of teeth permitting the tie member to slide across the shoulder in one direction but prevent movement of the tie member across the shoulder in the other direction wherein the anchor member and frame may be moved toward each other as the teeth slide across the shoulder in the one direction.

19. The grill assembly as set forth in claim 17 comprising means for securely attaching the anchor member to the interior peripheral edge and preventing movement between the anchor member and the outlet.

20. The grill assembly as set forth in claim 19 wherein the means for securely attaching the anchor member to the interior peripheral edge comprises at least one prong on the anchor member for engaging a corresponding hole disposed in the interior peripheral edge.

21. The grill assembly as set forth in claim 20 wherein the prong has a configuration for press fitting into the corresponding hole.

22. The grill assembly as set forth in claim 19 wherein the means for securely attaching the anchor member to the interior peripheral edge comprises at least one finger on the anchor member for engaging a sheet material surrounding the duct outlet.

23. The grill assembly as set forth in claim 19 wherein each arm comprises at least one spacer for engaging the periphery of the outlet.

24. The grill assembly as set forth in claim 23 wherein the spacer has a configuration for press fitting into the outlet.

25. The grill assembly as set forth in claim 17 wherein the frame has a body portion configured to engage and prevent damage to a peripheral wall of the outlet.

26. The grill assembly as set forth in claim 17 wherein the frame has a body portion configured to engage the periphery of the outlet and a shoulder projecting outwardly from the body portion for limiting insertion of the frame into the outlet.

27. The grill assembly as set forth in claim 17 wherein the frame comprises a plurality of vanes for directing the conditioned air.

28. The grill assembly as set forth in claim 17 wherein the frame comprises a damper for controlling the amount of conditioned air passing through the grill assembly.

29. The grill assembly as set forth in claim 17 comprising a cover for covering the frame and outlet and means for attaching the cover to the frame.

30. The grill assembly as set forth in claim 29 wherein the cover comprises a plurality of vanes for directing the conditioned air.

31. The grill assembly as set forth in claim 29 wherein the means for attaching the cover to the frame comprises a snap member disposed on the cover for slidably engaging a corresponding snap hole in the frame.

32. The grill assembly as set forth in claim 29 wherein the means for attaching the cover to the frame comprises a cover aperture for receiving the tie member.

33. A grill assembly for covering a duct outlet, the duct outlet defining interior and exterior peripheral edge, the grill assembly comprising:

an anchor member for mounting in the outlet having a middle portion and at least three spaced arms extending from the middle portion for engaging sides of the interior peripheral edge and releasably supporting the anchor member in the outlet without the need for a fastening member, a frame spaced from the anchor member for covering at least a portion of the exterior peripheral edge of the outlet, wherein the anchor member and frame have openings for permitting conditioned air to pass through the grill assembly, and means for attaching the frame to the anchor member having at least one anchor aperture disposed in the anchor member and at least one corresponding frame aperture in the frame, and a tie member for slidably engaging the anchor and frame apertures and holding the anchor member and frame together.

34. The grill assembly as set forth in claim 33 wherein each frame aperture defines a shoulder and the tie member comprises a plurality of teeth permitting the tie member to slide across the shoulder in one direction but prevent movement of the tie member across the shoulder in the other direction.

35. The grill assembly as set forth in claim 33 comprising means for securely attaching the anchor member to the periphery of the outlet and preventing movement between the anchor member and the outlet.

36. The grill assembly as set forth in claim 35 wherein the means for securely attaching the anchor member to the periphery of the outlet comprises at least one prong on the anchor member for engaging a corresponding hole disposed in the periphery of the outlet.

37. The grill assembly as set forth in claim 36 wherein the prong has a configuration for press fitting into the corresponding hole.

38. The grill assembly as set forth in claim 35 wherein the attaching means comprises at least one finger on the anchor member for engaging a sheet material surrounding the duct outlet.

39. The grill assembly as set forth in claim 35 wherein the attaching means comprises at least one spacer for engaging the periphery of the outlet.

40. The grill assembly as set forth in claim 39 wherein the spacer has a configuration for press fitting into the outlet.

41. The grill assembly as set forth in claim 33 wherein the frame has a body portion configured to engage and prevent damage to the periphery of the wall.

42. The grill assembly as set forth in claim 33 wherein the frame has a body portion configured to engage the periphery of the opening and a shoulder projecting outwardly from the body portion for limiting insertion of the frame into the outlet.

43. The grill assembly as set forth in claim 33 wherein the frame comprises a plurality of vanes for directing the conditioned air.

44. The grill assembly as set forth in claim 33 wherein the frame comprises a damper for controlling the amount of conditioned air passing through the grill assembly.

45. The grill assembly as set forth in claim 33 comprising a cover for covering the frame and outlet and means for attaching the cover to the frame.

46. The grill assembly as set forth in claim 45 wherein the cover comprises a plurality of vanes for directing the conditioned air.

47. The grill assembly as set forth in claim 45 wherein the means for attaching the cover to the frame comprises a snap member disposed on the cover for slidably engaging a corresponding snap hole in the frame.

48. The grill assembly as set forth in claim 45 wherein the attaching means comprises a cover aperture for receiving the tie member.

* * * * *